US010845074B2

(12) United States Patent
Solberg et al.

(10) Patent No.: US 10,845,074 B2
(45) **Date of Patent: *Nov. 24, 2020**

(54) FLUID FLOW MEASUREMENT AND CONTROL

(71) Applicant: TRANE INTERNATIONAL INC., Davidson, NC (US)

(72) Inventors: David Pierce Witten Solberg, Minneapolis, MN (US); Earl Orel Sanders, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 149 days.

This patent is subject to a terminal disclaimer.

(21) Appl. No.: 16/048,576

(22) Filed: Jul. 30, 2018

(65) Prior Publication Data

US 2018/0335226 A1 Nov. 22, 2018

Related U.S. Application Data

(63) Continuation of application No. 14/201,228, filed on Mar. 7, 2014, now Pat. No. 10,036,568.

(60) Provisional application No. 61/791,601, filed on Mar. 15, 2013.

(51) Int. Cl.

| | |
|---|---|
| ***F24F 11/30*** | (2018.01) |
| ***F24F 11/62*** | (2018.01) |
| ***F24F 11/83*** | (2018.01) |
| ***F24F 11/72*** | (2018.01) |

(52) U.S. Cl.

CPC ..... *F24F 11/30* (2018.01); *F24F 11/62* (2018.01); *F24F 11/72* (2018.01); *F24F 11/83* (2018.01)

(58) Field of Classification Search

CPC .. F24F 11/30; F24F 11/62; F24F 11/83; F24F 11/72

See application file for complete search history.

(56) References Cited

U.S. PATENT DOCUMENTS

| | | | |
|---|---|---|---|
| 3,010,316 | A | 11/1961 | Snyder |
| 3,830,256 | A | 8/1974 | Cox |
| 4,030,523 | A | 6/1977 | Cram et al. |
| 4,170,245 | A | 10/1979 | Haley et al. |
| 4,256,100 | A | 3/1981 | Levy et al. |
| 4,417,312 | A | 11/1983 | Cronin et al. |

(Continued)

FOREIGN PATENT DOCUMENTS

WO 2011054518 5/2011

OTHER PUBLICATIONS

Flow Control Industries, Inc.; Product Catalog—High Performance Control Valves; Jul. 2012; Delta P. Valve; Woodinville, Washington (20 pages).

*Primary Examiner* — Eric Keasel

(74) *Attorney, Agent, or Firm* — Hamre, Schumann, Mueller & Larson, P.C.

(57) ABSTRACT

In at least one illustrative embodiment, a fluid flow control apparatus may comprise a fluid network including a plurality of parallel branches, each parallel branch of the plurality of parallel branches being fluidly coupled between an inlet and an outlet of the fluid network. Each parallel branch of the plurality of parallel branches may comprise a pressure-independent flow control device configured to limit fluid flow through the respective parallel branch to a reference flow amount irrespective of a pressure at the inlet of the fluid network.

13 Claims, 2 Drawing Sheets

(56) References Cited

U.S. PATENT DOCUMENTS

| | | | |
|---|---|---|---|
| 4,518,011 | A | 5/1985 | Stoll |
| 5,065,794 | A | 11/1991 | Cheung |
| 5,329,965 | A | 7/1994 | Gordon |
| 5,875,817 | A | 3/1999 | Carter |
| 5,938,425 | A | 8/1999 | Damrath et al. |
| 6,532,754 | B2 | 3/2003 | Haley et al. |
| 6,666,042 | B1 | 12/2003 | Cline et al. |
| 8,555,920 | B2 | 10/2013 | Hirata et al. |
| 9,157,461 | B2 | 10/2015 | Mehling et al. |
| 10,036,568 | B2 * | 7/2018 | Solberg ..... F24F 11/72 |

* cited by examiner

FLUID FLOW MEASUREMENT AND CONTROL

CROSS REFERENCE TO RELATED APPLICATION

This application claims the benefit of U.S. Provisional Patent Application Ser. No. 61/791,601, filed Mar. 15, 2013, the entire disclosure of which is incorporated by reference herein.

BACKGROUND

Flow meters are often used to measure a fluid flow amount or rate. The measurement range over which a flow meter must operate may be large, despite the flow meter being calibrated to a particular flow point. As the actual fluid flow diverges from the calibrated flow point, the flow meter typically becomes less accurate in its measurements. Furthermore, a flow control system relying on measurements from such a flow meter may have difficulty maintaining stable and precise fluid flow.

SUMMARY

According to one aspect, a fluid flow control apparatus may comprise a fluid network including a plurality of parallel branches, each parallel branch of the plurality of parallel branches being fluidly coupled between an inlet and an outlet of the fluid network, wherein each parallel branch of the plurality of parallel branches comprises a pressure-independent flow control device configured to limit fluid flow through the respective parallel branch to a reference flow amount irrespective of a pressure at the inlet of the fluid network.

In some embodiments, the fluid flow control apparatus may further comprise a controller operatively coupled to the pressure-independent flow control devices of the plurality of parallel branches. The controller may be configured to select a set of parallel branches from among the plurality of parallel branches and control the pressure-independent flow control devices to (i) block fluid flow through each of the plurality of parallel branches that are not in the selected set of parallel branches and (ii) limit fluid flow through each of the plurality of parallel branches that are in the selected set of parallel branches to the respective reference flow amount. The controller may be configured to select the set of parallel branches such that a sum of the reference flow amounts of the selected set of parallel branches approximates a flow amount setpoint.

In some embodiments, the fluid network may further include an additional parallel branch fluidly coupled between the inlet and the outlet of the fluid network. The additional parallel branch may comprise a pressure-independent flow control device configured to limit fluid flow through the additional parallel branch to a variable flow amount irrespective of the pressure at the inlet of the fluid network. The fluid flow control apparatus may further comprise a controller operatively coupled to the pressure-independent flow control devices of the plurality of parallel branches and to the pressure-independent flow control device of the additional parallel branch. The controller may be configured to select a set of parallel branches from among the plurality of parallel branches, select the variable flow amount of the additional parallel branch, and control the pressure-independent flow control devices to (i) block fluid flow through each of the plurality of parallel branches that are not in the selected set of parallel branches, (ii) limit fluid flow through each of the plurality of parallel branches that are in the selected set of parallel branches to the respective reference flow amount, and (iii) limit fluid flow through the additional parallel branch to the variable flow amount.

In some embodiments, the controller may be configured to select the set of parallel branches such that a sum of the reference flow amounts of the selected set of parallel branches is less than a flow amount setpoint and select the variable flow amount of the additional parallel branch to be a difference between the flow amount setpoint and the sum of the reference flow amounts of the selected set of parallel branches. The variable flow amount may be smaller than the reference flow amounts of the plurality of parallel branches.

In some embodiments, the fluid flow control apparatus may further comprise a flow meter fluidly coupled in series with the fluid network. The flow meter may be configured to measure a total flow amount through the fluid network and to provide the total flow amount to the controller for comparison to the flow amount setpoint. The reference flow amounts of the plurality of parallel branches may be equal. The reference flow amounts of the plurality of parallel branches may be configured in a geometric sequence. A common ratio of the geometric sequence may be two. The pressure-independent flow control devices of the plurality of parallel branches may each comprise a controlled value and a pilot-operated pressure regulator configured to maintain a fixed pressure differential across the controlled valve.

According to another aspect, a chiller system may comprise a chiller configured to remove heat from a cooling fluid, a pump fluidly coupled to the chiller and configured to circulate the cooling fluid between the chiller and a heat exchanger, and any of the foregoing fluid flow control apparatus, wherein the fluid network of the fluid flow control apparatus is fluidly coupled between the pump and the heat exchanger.

In some embodiments, the pump may be configured to circulate the cooling fluid between the chiller and the heat exchanger by creating the pressure at the inlet of the fluid network. The chiller system may further comprise a flow meter fluidly coupled in series with the fluid network of the fluid flow control apparatus, where the flow meter is configured to measure a total flow amount through the fluid network. The reference flow amounts of the plurality of parallel branches may be equal. The reference flow amounts of the plurality of parallel branches may be configured in a geometric sequence. A common ratio of the geometric sequence may be two.

According to another aspect, a method of controlling fluid flow may comprise selecting a set of parallel branches from among a plurality of parallel branches of a fluid network, where each of the plurality of parallel branches is fluidly coupled between an inlet and an outlet of the fluid network and comprising a pressure-independent flow control device, blocking fluid flow through each of the plurality of parallel branches that are not in the selected set of parallel branches, and limiting fluid flow through each of the plurality of parallel branches that are in the selected set of parallel branches, using the respective pressure-independent flow control device, to a reference flow amount irrespective of a pressure at the inlet of the fluid network.

In some embodiments, blocking fluid flow may comprise entirely closing a controlled valve of each of the pressure-independent flow control devices of the plurality of parallel branches that are not in the selected set of parallel branches. Selecting a set of parallel branches may comprise selecting the set of parallel branches such that a sum of the reference flow amounts of the selected set of parallel branches approximates a flow amount setpoint.

In some embodiments, the method may further comprise limiting fluid flow through an additional parallel branch, using a pressure-independent flow control device of the additional parallel branch, to a variable flow amount irrespective of a pressure at the inlet of the fluid network, wherein the additional parallel branch is fluidly coupled between the inlet and the outlet of the fluid network. Selecting a set of parallel branches may comprise selecting the set of parallel branches such that a sum of the reference flow amounts of the selected set of parallel branches is less than a flow amount setpoint, and limiting the variable flow of the additional parallel branch may comprise selecting the variable flow amount to be a difference between the flow amount setpoint and the sum of the reference flow amounts of the selected set of parallel branches. The variable flow amount may be smaller than the reference flow amounts of the plurality of parallel branches.

In some embodiments, the reference flow amounts of the plurality of parallel branches may be equal. In other embodiments, the reference flow amounts of the plurality of parallel branches may be configured in a geometric sequence. A common ratio of the geometric sequence may be two.

BRIEF DESCRIPTION OF THE DRAWINGS

The concepts described in the present disclosure are illustrated by way of example and not by way of limitation in the accompanying drawings. For simplicity and clarity of illustration, elements illustrated in the drawings are not necessarily drawn to scale. For example, the dimensions of some elements may be exaggerated relative to other elements for clarity.

DETAILED DESCRIPTION OF THE DRAWINGS

Figure 1:
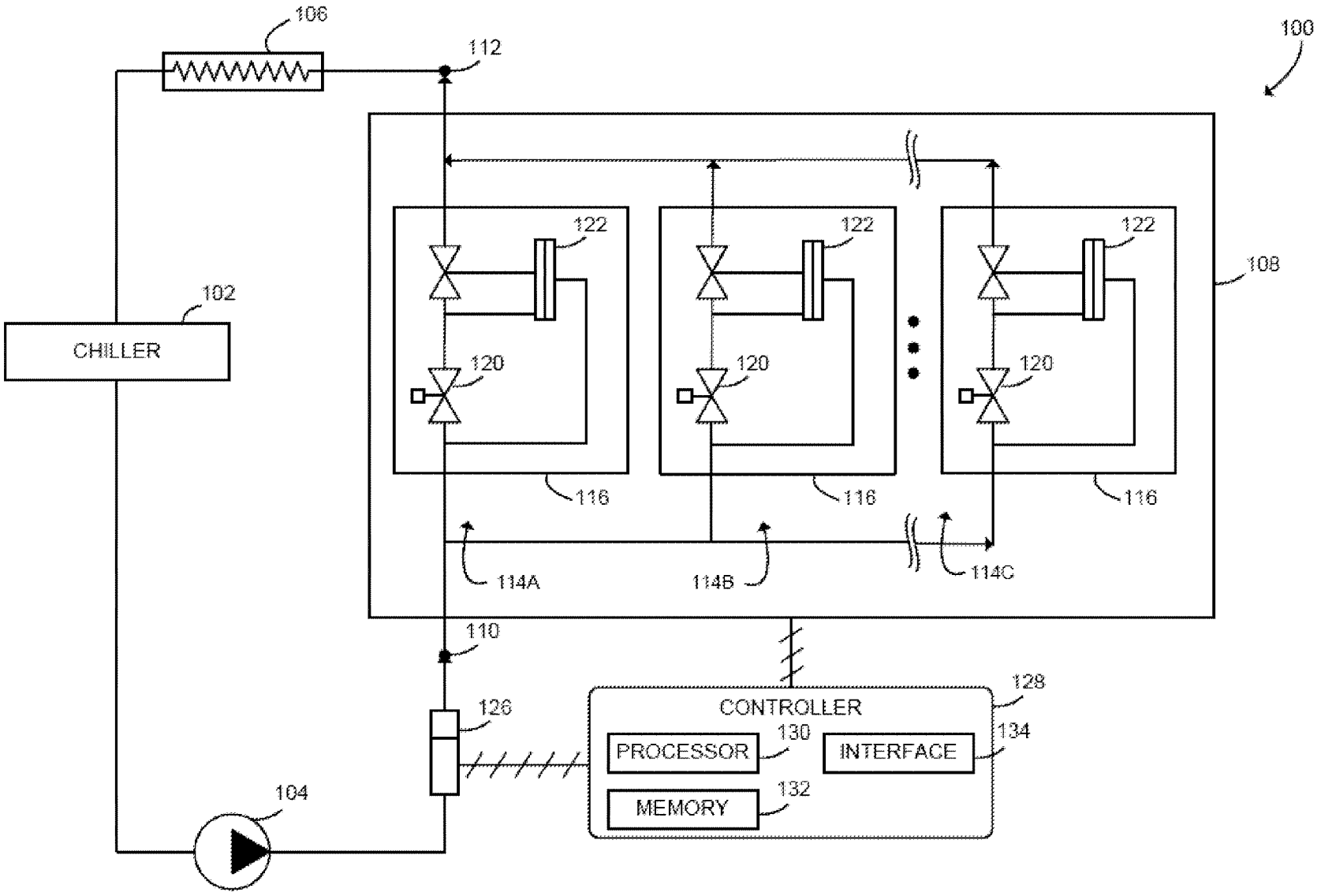
FIG. 1 is a simplified schematic diagram of one illustrative embodiment of a chiller system comprising fluid flow control apparatus.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative drawings. Additionally, the inclusion of a structural or method feature in a particular drawing is not meant to imply that such feature is required in all embodiments and, in some embodiments, may not be included or may be combined with other features.

Referring now to FIG. 1, one illustrative embodiment of a chiller system 100 is shown as a simplified schematic diagram. In this illustrative embodiment, the chiller system 100 comprises a chiller 102, a pump 104, a heat exchanger 106, a fluid network 108, a flow meter 126, and a controller 128. The chiller 102, the pump 104, the heat exchanger 106, the fluid network 108, and the flow meter 126 are fluidly coupled (e.g., using a number of pipes or other conduits), as shown in FIG. 1, to allow circulation of a cooling fluid. In the illustrative embodiment, the cooling fluid is water. In other embodiments, other fluids (e.g., glycol) may be used as the cooling fluid. It will be appreciated that, in some embodiments, the chiller system 100 may include additional or different components to those shown in FIG. 1.

The chiller 102 of the chiller system 100 may be embodied as any device(s) configured to cool the cooling fluid as it passes through the chiller 102. In the illustrative embodiment, the chiller 102 includes a centrifugal compressor that discharges refrigerant in series through a condenser, a flow restriction, and an evaporator (after which the refrigerant returns to the compressor). As the refrigerant passes through the evaporator of the chiller 102, it removes heat from the cooling fluid circulating through the chiller system 100. It will be appreciated that, in some embodiments, the chiller 102 may include additional or different components to those just described. For instance, the chiller 102 might utilize a screw compressor, a scroll compressor, or a reciprocating compressor (rather than a centrifugal compressor). While only one chiller 102 is shown in FIG. 1, the chiller system 100 may include any number of chillers 102 in other embodiments.

The chiller system 100 also includes a pump 104 to circulate the cooling fluid through the chiller system 100. In the illustrative embodiment shown in FIG. 1, the cooling fluid leaving the pump 104 circulates through the flow network 108, then the heat exchanger(s) 106, then the chiller 102, and then returns to the pump 104. The pump 104 may be embodied as any device(s) configured to create and/or maintain pressure in the chiller system 100. In the illustrative embodiment, the pump 104 creates pressure at an inlet 110 of the fluid network 108. While only one pump 104 is shown in FIG. 1, the chiller system 100 may include any number of pumps 104 in other embodiments.

The heat exchanger 106 of the chiller system 100 may be embodied as any device(s) configured to cool another fluid (e.g., air) by transferring heat to the cooling fluid circulating through the chiller system 100. By way of example, the heat exchanger 106 may be illustratively embodied as a coil 106 positioned in a portion of a building to cool air in that portion of the building. The cooling effect of the heat exchanger 106 may be adjusted by controlling the amount, or rate, of cooling fluid passing through the heat exchanger 106. As described further below, this control of the amount of cooling fluid passing through the heat exchanger 106 is accomplished by a fluid flow control apparatus including the fluid network 108. While only one heat exchanger 106 is shown in FIG. 1, the chiller system 100 may include any number of heat exchangers 106 in other embodiments. In such embodiments, the amount of cooling fluid passing through each heat exchanger 106 may be controlled by a separate fluid flow control apparatus. Alternatively, one fluid flow control apparatus may control the amount of cooling fluid passing through multiple heat exchangers 106.

As shown in FIG. 1, the fluid network 108 includes a plurality of parallel branches 114. While three parallel branches 114A, 114B, and 114C are specifically shown in FIG. 1, it is contemplated that the fluid network 108 may comprise any number of parallel branches 114. Each of the parallel branches 114 is fluidly coupled between the inlet 110 and an outlet 112 of the fluid network 108. As described in more detail below, the parallel branches 114 divide the overall fluid flow through the fluid network 108 into a number of component fluid flows, allowing for more accurate and precise measurement and control. In the illustrative embodiment, each of the parallel branches 114 of the fluid network 108 comprises a pressure-independent flow control device 116.

The pressure-independent flow control device 116 of each parallel branch 114 may be embodied as any device(s) configured to limit fluid flow through that parallel branch 114 to a particular flow amount irrespective of the pressure at the inlet 110 of the fluid network 108. In the illustrative embodiment of FIG. 1, each pressure-independent flow control device 116 includes a controlled valve, or orifice, 120 and a pilot-operated pressure regulator 122. The pilot-operated pressure regulator 122 maintains a fixed pressure differential across the controlled valve 120. As such, regardless of the system differential pressure, the pressure-independent flow control device 116 is operable to maintain a particular flow amount. In some embodiments, the pilot-operated pressure regulator 122 may be integrally formed with the controlled valve 120. For instance, the pressure-independent flow control device 116 may be illustratively embodied as a DeltaPValve, commercially available from Flow Control Industries, Inc., of Woodinville, Wash. The DeltaPValve is further described in Flow Control Industries' "Product Catalog: High-Performance Control Valves" (2010), which is incorporated by reference herein in its entirety.

The particular flow amount maintained by the pressure-independent flow control device 116 of each parallel branch 114 may be set to a predetermined value or may be adjusted dynamically (e.g., by the controller 128, as described further below). In the illustrative embodiment, the fluid network 108 includes one parallel branch 114A in which the pressure-independent flow control device 116 limits fluid flow through the parallel branch 114A to a variable flow amount. The pressure-independent flow control device 116 of each of the remaining parallel branches 114B, 114C of the fluid network 108 limits fluid flow through the respective parallel branch 114B, 114C to a predetermined reference flow amount. Once again, although only two such parallel branches 114B, 114C are shown in FIG. 1, the fluid network 108 may include any number of parallel branches 114 with a pressure-independent flow control device 116 that limits fluid flow to a predetermined reference flow amount. In the illustrative embodiment, the parallel branches 114B, 114C are set to reference flow amounts corresponding to their calibration points, while the variable flow amount of the parallel branch 114A is operated as close as possible to its calibration point, to minimize uncertainty. In the illustrative embodiment, the variable flow amount of the parallel branch 114A is smaller than the reference flow amounts of the parallel branches 114B, 114C.

In the illustrative embodiment, the reference flow amounts maintained in the parallel branches 114B, 114C are arranged in a geometric sequence. In other words, the reference flow amounts of each parallel branch 114B, 114C generally follow the formula $a_n=a_1r^{n-1}$, where $a_1$ is the reference flow amount of the parallel branch 114B, $a_n$ is the reference flow amount of the n-th parallel branch 114C, and r is the common ratio. By way of example, where the reference flow amount of the parallel branch 114B was set to two (i.e., $a_1=2$) and the common ratio is two (i.e., r=2), the reference flow amounts of the parallel branches 114B, 114C would be: 2, 4, 8, 16, 32, etc. In other embodiments, the reference flow amount maintained in each of the parallel branches 114B, 114C may be equal. As described further below, various combinations of the reference flow amounts of the parallel branches 114B, 114C, as well as the variable flow amount of the parallel branch 114A, can achieve a wide range of total flow amounts through the fluid network 108, with a high degree of accuracy and precision.

In the illustrative embodiment, the controller 128 of the chiller system 100 is operatively coupled to the pressure-independent flow control devices 116 of each of the parallel branches 114 of the fluid network 108. As such, the controller 128 is able to control the operation of each of the pressure-independent flow control devices 116. The controller 128 is, in essence, a master computer responsible for activating or energizing electronically-controlled components associated with the chiller system 100. Among other operations, the controller 128 is operable to accurately and precisely control total fluid flow through the fluid network 108 to a desired setpoint, as will be described in more detail below with reference to FIG. 2.

To do so, the controller 128 includes a number of electronic components commonly associated with electronic control units utilized in the control of electromechanical systems. In the illustrative embodiment, the controller 128 of the chiller system 100 includes a processor 130, a memory 132, and an interface 134. It will be appreciated that the controller 128 may include additional or different components, such as those commonly found in a computing device (e.g., various input/output devices). Additionally, in some embodiments, one or more of the illustrative components of the controller 128 may be incorporated in, or otherwise form a portion of, another component of the controller 128 (e.g., as with a microcontroller).

The processor 130 of the controller 128 may be embodied as any type of processor capable of performing the functions described herein. For example, the processor may be embodied as one or more single or multi-core processors, digital signal processors, microcontrollers, or other processors or processing/controlling circuits. Similarly, the memory 132 may be embodied as any type of volatile or non-volatile memory or data storage device capable of performing the functions described herein. The memory 132 stores various data and software used during operation of the controller 128, such as operating systems, applications, programs, libraries, and drivers. For instance, the memory 132 may store instructions in the form of a software routine (or routines) which, when executed by the processor 130, allows the controller 128 to control operation of the pressure-independent flow control devices 116.

The interface 134 of the controller 128 may be embodied as circuitry and/or components to facilitate I/O operations of the controller 128. In the illustrative embodiment, the interface 134 includes an analog-to-digital ("A/D") converter, or the like, that converts analog signals from received from components of the chiller system 100 into digital signals for use by the processor 130. It should be appreciated that, if any one or more of the components of the chiller system 100 generates a digital output signal, the A/D converter may be bypassed. Similarly, in the illustrative embodiment, the interface 134 includes a digital-to-analog ("D/A") converter, or the like, that converts digital signals from the processor 130 into analog signals for use by components of the chiller system 100 (e.g., the pressure-independent flow control devices 116). It should also be appreciated that, if any one or more of the components of the chiller system 100 operates using a digital input signal, the D/A converter may be bypassed.

By controlling the pressure-independent flow control devices 116 of each of the parallel branches 114 of the fluid network 108, the controller 128 is operable to accurately and precisely control total fluid flow through the fluid network 108 to a desired setpoint. As described further below with reference to FIG. 2, the controller 128 may select a set of the parallel branches 114, which may include some or all of the parallel branches 114, for which a sum of the reference flow amounts through those parallel branches 114 approximates the desired flow amount setpoint. The controller 128 may then control the pressure-independent flow control devices 116 to block fluid flow through the parallel branches 114, if any, that are not in the selected set of parallel branches 114. In some embodiments, the controller 128 may also dynamically control the variable flow amount of the parallel branch 114A to achieve the desired fluid flow set point. For instance, where the sum of reference flow amounts through the selected set of parallel branches 114B, 114C is less than the desired flow amount setpoint, the variable flow amount of the parallel branch 114A may be set to a difference between this sum and the desire flow amount setpoint.

In some embodiments, the chiller system 100 may further include a flow meter 126 that is fluidly coupled in series with the fluid network 108 and that measures a total flow amount through the fluid network 108. In the illustrative embodiment, the flow meter 126 is fluidly coupled between the pump 104 and the inlet 110 of the fluid network 108. In other embodiments, the flow meter 126 may be fluidly coupled between the outlet 112 of the fluid network 108 and the heat exchanger 106. The flow meter 126 generates an output signal representing the total flow amount through the fluid network 108. This output signal of the flow meter 126 is provided to the controller 128 for comparison to the desired flow amount setpoint. It is contemplated that, in some embodiments, the chiller system 100 may include multiple flow networks 108 (each with a plurality of parallel branches 114) and multiple flow meters 126. In such embodiments, one fluid network 108 and flow meter 126 may be operated at a variable setpoint, while the remaining fluid networks 108 and flow meters 126 may be operated at different fixed setpoints.

Figure 2:
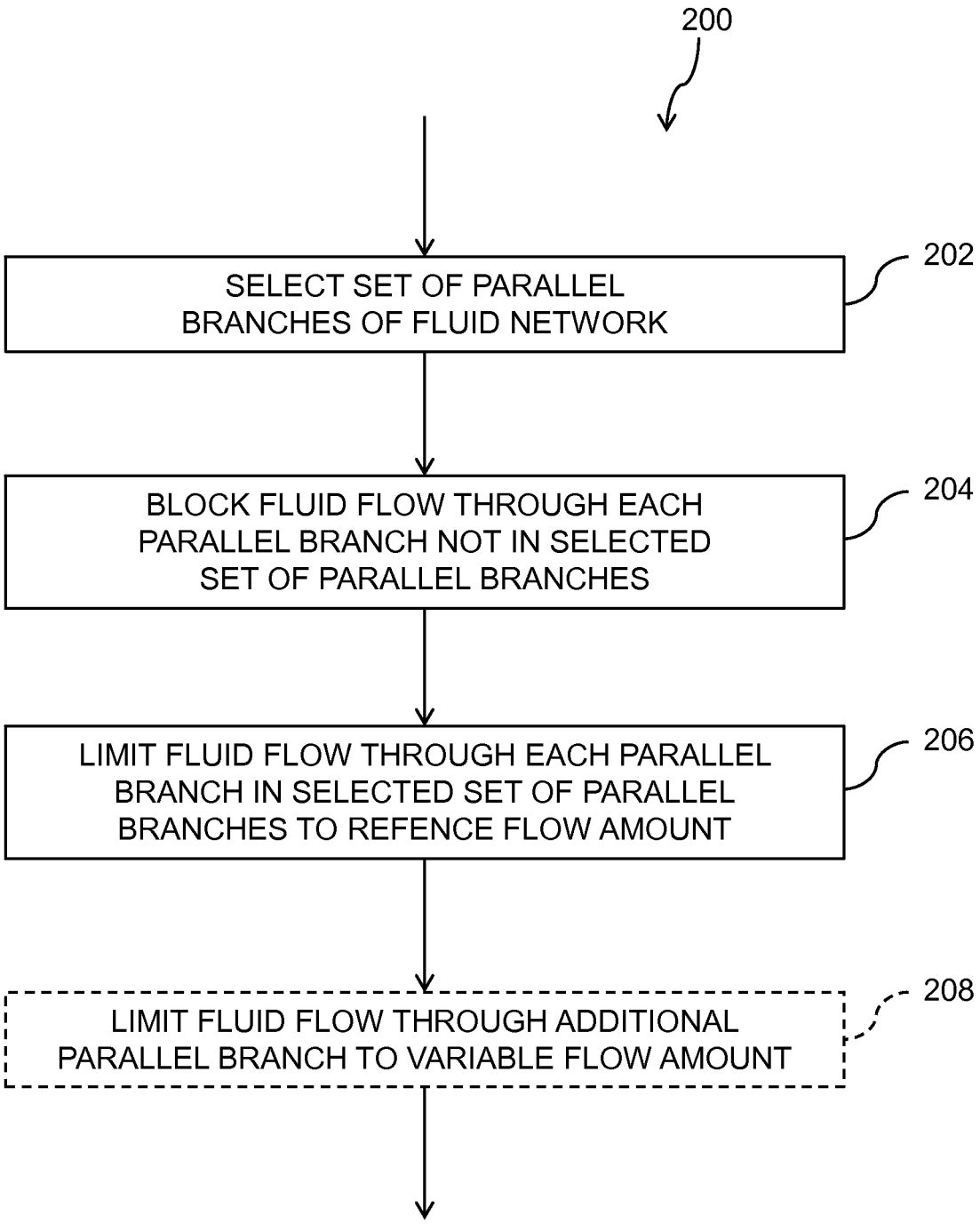
FIG. 2 is a simplified flow diagram of one illustrative embodiment of a method of controlling fluid flow.

Referring now to FIG. 2, one illustrative embodiment of a method 200 that uses fluid flow control apparatus to control fluid flow to a setpoint is shown as a simplified flow diagram. In the illustrative embodiment, the method 200 may be executed by the fluid flow control apparatus of the chiller system 100 described above. In particular, the method 200 may be executed by the controller 128 in conjunction with the pressure-independent flow control devices 116 of each of the parallel branches 114 of the fluid network 108. It will be appreciated that, in other embodiments, other fluid flow control apparatus may be used to perform the method 200.

The method begins with block 202 in which the controller 128 selects a set of parallel branches 114 from among the plurality of parallel branches 114 of the fluid network 108. The controller 128 generally selects the set of parallel branches 114 to achieve a desired flow amount setpoint. As described above, the pressure-independent flow control devices 116 of each of the parallel branches 114B, 114C are set limit fluid flow to predetermined reference flow amounts (corresponding to their calibration points). In some embodiments, the controller 128 may select the set of parallel branches 114 such that a sum of their reference flow amounts approximates the desired flow amount setpoint. For instance, where the desired flow amount setpoint is twelve units, the controller may select a parallel branch 114 calibrated to limit fluid flow to eight units and a parallel branch 114 calibrated to limit fluid flow to four units.

After block 202, the method 200 proceeds to block 204 in which the controller 128 controls the pressure-independent flow control devices 116 of the fluid network 108 to block fluid flow through each of the parallel branches 114 that are not in the set selected in block 202. In some embodiments, block 204 may involve the controller 128 sending a control signal to the pressure-independent flow control devices 116 of each of the non-selected parallel branches 114 to entirely close their controlled valves 120 (and, thus, block fluid flow). If any of the controlled valves 120 of the pressure-independent flow control devices 116 of the parallel branches 114 selected in block 202 were previously closed, block 204 may also involve controller 128 sending a control signal that causes those controlled valves 120 to open.

After block 204, the method 200 proceeds to block 206 in which the pressure-independent flow control devices 116 of each of the parallel branches 114 that were selected in block 202 (i.e., the parallel branches 114 with open controlled valves 120 after block 204) limit fluid flow through to a reference flow amount. As described above, the pressure-independent flow control devices 116 are operable to maintain a predetermined reference flow amount irrespective of the pressure at the inlet 110 of the fluid network 108. As each of the pressure-independent flow control devices 116 is operated at its respective calibration point, each pressure-independent flow control device 116 in the selected set will accurately control the fluid flow through its respective parallel branch 114. During block 206, the sum of the reference flow amounts though each of the selected set of parallel branches 114 will be the total flow amount through the fluid network 108.

In some embodiments, the method 200 may optionally include block 208, which may be performed simultaneously with block 206. During block 208, the controller 128 may select a variable flow amount for the pressure-independent flow control device 116 of the parallel branch 114A and transmit a control signal representing the selected variable flow amount to the pressure-independent flow control device 116 of the parallel branch 114A. The pressure-independent flow control device 116 of the parallel branch 114A may then limit fluid flow through the parallel branch 114A to this variable flow amount. Block 208 may be used where the sum of the reference flow amounts of the parallel branches 114 selected in block 202 is less the desired flow amount setpoint. To address this, the controller 128 may select the variable flow amount to be the difference between the flow amount setpoint and the sum of the reference flow amounts of the parallel branches 114 selected in block 202. As such, the total fluid flow through the fluid network 108 will then achieve the desire flow amount setpoint.

While the fluid flow control apparatus and methods disclosed herein have been illustratively described in the context of a chiller system 100, it will be appreciated that the presently disclosed fluid flow control apparatus and methods may be used in any number of systems were the accurate measurement of fluid flow and/or the stable and precise control of fluid flow is desired. By way of illustrative example, the fluid flow control apparatus and methods might be used to measure and/or control fluid flow in the refrigerant circuit of the chiller 102.

The presently disclosed fluid flow control apparatus and methods allow fluid flows to be measured and/or controlled at much higher accuracies than prior systems. By way of example, current technologies have a difficult time in measuring or controlling fluid flow at 1.5% accuracies over a flow range of approximately 10:1 to 25:1. By contrast, the presently disclosed fluid flow control apparatus and methods will allow flows to be controlled at 0.025% accuracy over a range of 150:1 or more. It will be appreciated that this increase in accuracy may significantly improve the accuracy and/or efficiency of a system (e.g., the chiller system 100) using the presently disclosed fluid flow control apparatus and methods.

While certain illustrative embodiments have been described in detail in the drawings and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A controlled fluid pressure system to regulate fluid flow through a system having a chiller fluidly coupled with a pump, the pump configured to circulate a cooling fluid between the chiller and a heat exchanger, the controlled fluid pressure system comprising:

a fluid network, the fluid network including a plurality of parallel branches fluidly coupled between an inlet and an outlet of the fluid network, each parallel branch of the plurality of parallel branches includes a pressure-independent flow control device configured to limit fluid flow through the respective parallel branch to a predetermined flow amount, wherein the fluid network includes an additional parallel branch fluidly coupled between the inlet and the outlet of the fluid network, the additional parallel branch comprising a pressure-independent flow control device configured to limit fluid flow through the additional parallel branch to a variable flow amount;

a controller operatively coupled to the pressure-independent flow control devices of the plurality of parallel branches and to the pressure-independent flow control device of the additional parallel branch, the controller configured to:

select a set of parallel branches from among the plurality of parallel branches;

select the variable flow amount of the additional parallel branch; and control the pressure-independent flow control devices to (i) block fluid flow through each of the plurality of parallel branches that are not in the selected set of parallel branches, (ii) limit fluid flow through each of the plurality of parallel branches that are in the selected set of parallel branches to the respective predetermined flow amount, and (iii) limit fluid flow through the additional parallel branch to the variable flow amount.

2. The fluid flow control apparatus of claim 1, wherein the controller is configured to select the set of parallel branches such that a sum of the predetermined flow amounts of the selected set of parallel branches approximates a flow amount setpoint.

3. The fluid flow control apparatus of claim 1, wherein the controller is configured to:

select the set of parallel branches such that a sum of the predetermined flow amounts of the selected set of parallel branches is less than a flow amount setpoint; and select the variable flow amount of the additional parallel branch to be a difference between the flow amount setpoint and the sum of the predetermined flow amounts of the selected set of parallel branches.

4. The fluid flow control apparatus of claim 1, wherein the variable flow amount is smaller than the predetermined flow amounts of the plurality of parallel branches.

5. The fluid flow control apparatus of claim 1, further comprising a flow meter fluidly coupled in series with the fluid network, the flow meter being configured to measure a total flow amount through the fluid network and to provide the total flow amount to the controller for comparison to a flow amount setpoint.

6. The fluid flow control apparatus of claim 1, wherein the predetermined flow amounts of the plurality of parallel branches are equal.

7. The fluid flow control apparatus of claim 1, wherein the predetermined flow amounts of the plurality of parallel branches are configured in a geometric sequence.

8. The fluid flow apparatus of claim 7, wherein a common ratio of the geometric sequence is two.

9. The fluid flow control apparatus of claim 1, wherein the pressure independent flow control devices of the plurality of parallel branches each comprise a controlled valve and a pilot-operated pressure regulator configured to maintain a fixed pressure differential across the controlled valve.

10. A method of controlling fluid flow through a system having a chiller fluidly coupled with a pump, the pump configured to circulate a cooling fluid between the chiller and a heat exchanger, comprising:

selecting, using a controller, a set of parallel branches from among a plurality of parallel branches of a fluid network, each of the plurality of parallel branches being fluidly coupled between an inlet and an outlet of the fluid network, each of the plurality of parallel branches comprising a pressure-independent flow control device configured to limit flow through the respective parallel branch to a predetermined flow amount, and the fluid network further includes an additional parallel branch including a pressure-independent flow control device configured to limit flow through the additional parallel branch to a variable flow amount;

selecting, using the controller, the variable flow amount;

blocking fluid flow through each of the plurality of parallel branches that are not in the selected set of parallel branches;

limiting fluid flow through each of the plurality of parallel branches that are in the selected set of parallel branches, using the respective pressure-independent flow control device, to the predetermined flow amount; and limiting fluid flow through the additional parallel branch to the selected variable flow amount.

11. The method of claim 10, wherein blocking fluid flow comprises entirely closing a controlled valve of each of the pressure-independent flow control devices of the plurality of parallel branches that are not in the selected set of parallel branches.

12. The method of claim 10, wherein selecting a set of parallel branches comprises selecting the set of parallel branches such that a sum of the predetermined flow amounts of the selected set of parallel branches approximates a flow amount setpoint.

13. The method of claim 10, wherein: selecting a set of parallel branches comprises selecting the set of parallel branches such that a sum of the predetermined flow amounts of the selected set of parallel branches is less than a flow amount setpoint; and limiting the variable flow of the additional parallel branch comprises selecting the variable flow amount to be a difference between the flow amount setpoint and the sum of the predetermined flow amounts of the selected set of parallel branches.

* * * * *